US005169103A

United States Patent [19]

Jimenez et al.

[11] Patent Number: 5,169,103

[45] Date of Patent: Dec. 8, 1992

[54] HAND STAND FOR NAIL WORK

[76] Inventors: Nancy Jimenez; Carl T. Hodges, both of 235 SW. Le Jeune Rd., Miami, Fla. 33134

[21] Appl. No.: 757,540

[22] Filed: Sep. 11, 1991

[51] Int. Cl.[5] ..... A45D 29/00

[52] U.S. Cl. ..... 248/118; 132/73

[58] Field of Search ..... 248/118, 118.1, 118.3, 248/118.5; 132/73, 73.5, 75

[56] References Cited

U.S. PATENT DOCUMENTS

| | | | |
|---|---|---|---|
| 443,839 | 12/1890 | Steinhauer | 248/118 |
| 455,583 | 7/1891 | Steinhauer | 248/118 |
| 915,047 | 3/1909 | Smith | 248/118 |
| 1,025,476 | 5/1912 | Mellen | 248/118 |
| 2,477,898 | 8/1949 | Rehman et al. | 248/118 |
| 2,676,597 | 4/1954 | Colbert | 132/73 |
| 3,022,622 | 6/1991 | Schaevitz | 248/118 X |
| 4,329,002 | 5/1982 | Cowen et al. | 132/73 X |
| 4,332,263 | 6/1982 | Kitrell | 248/118 X |
| 4,915,331 | 4/1990 | Becker et al. | 248/118 |

*Primary Examiner*—David L. Talbott
*Attorney, Agent, or Firm*—J. Sanchelima

[57] ABSTRACT

A stand to support a patron's hand in suspension and contributes to better posture for the nail technicians that includes a base assembly that rests on a flat horizontal surface and a diagonal flat member rigidly attached to the base assembly, at an angle between 30 and 60 degrees with respect to the resting horizontal surface. Padded sheets are used to provide comfort to a patron's elbow and, when needed, to prop it up using padded sheets of different widths.

8 Claims, 2 Drawing Sheets

HAND STAND FOR NAIL WORK

BACKGROUND OF THE INVENTION

1. Field of the Invention

The present invention relates to stands for nail work, and, more particularly, to those stands that are ergonometrically designed to permit the patron to comfortably rest his arm and hand on the stand while permitting the nail work technician to easily manipulate the patron's fingers.

2. Description of the Related Art

There have been several devices designed in the past to facilitate the work of manicure personnel. One of these devices is disclosed in U.S. Pat. No. 4,915,331 issued to Becker, et al., on Apr. 10, 1990. As disclosed in this patent, the invention includes a base that grips the tabletop and is designed to resist sliding. A wrist support is adjustably mounted to the base and keeps the hand elevated so that the proper manicure treatment can be administered. However, it is very difficult for a user to relax his hand from the wrist out. Furthermore, the finger support bar 44 prevents a nail worker to readily manipulate the fingers.

SUMMARY OF THE INVENTION

It is one of the main objects of the present invention to provide a stand that permits a patron to rest his forearm and wrist on it so that he or she may completely relax his fingers for readily manipulation by a nail worker.

It is another object of this present invention to provide a stand that is ergonometrically designed so that a patron's forehand can comfortably rest on the stand while his or her hand drops suspended in the air for its ready manipulation by a worker thereby contributing to a more comfortable posture for the latter.

It is still another object of this present invention to provide such a stand that is volumetrically efficient and of light weight so that it can be readily transported and/or stored.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 2:
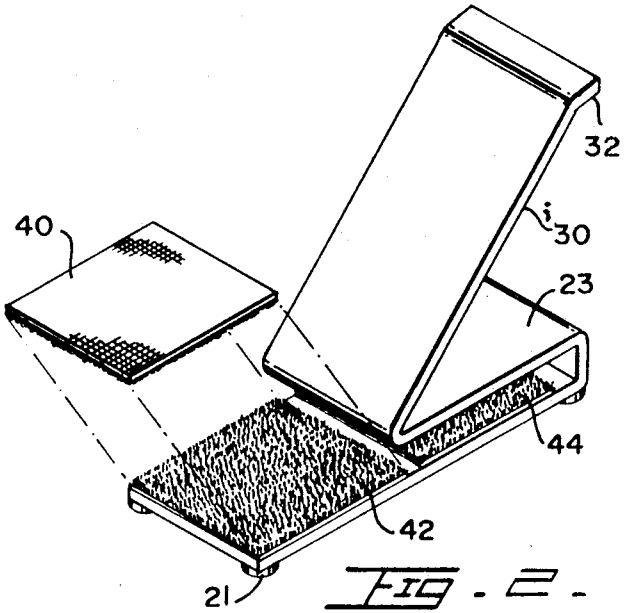
FIG. 2 shows an isometric view of the stand shown in FIG. 1.
Figure 1:
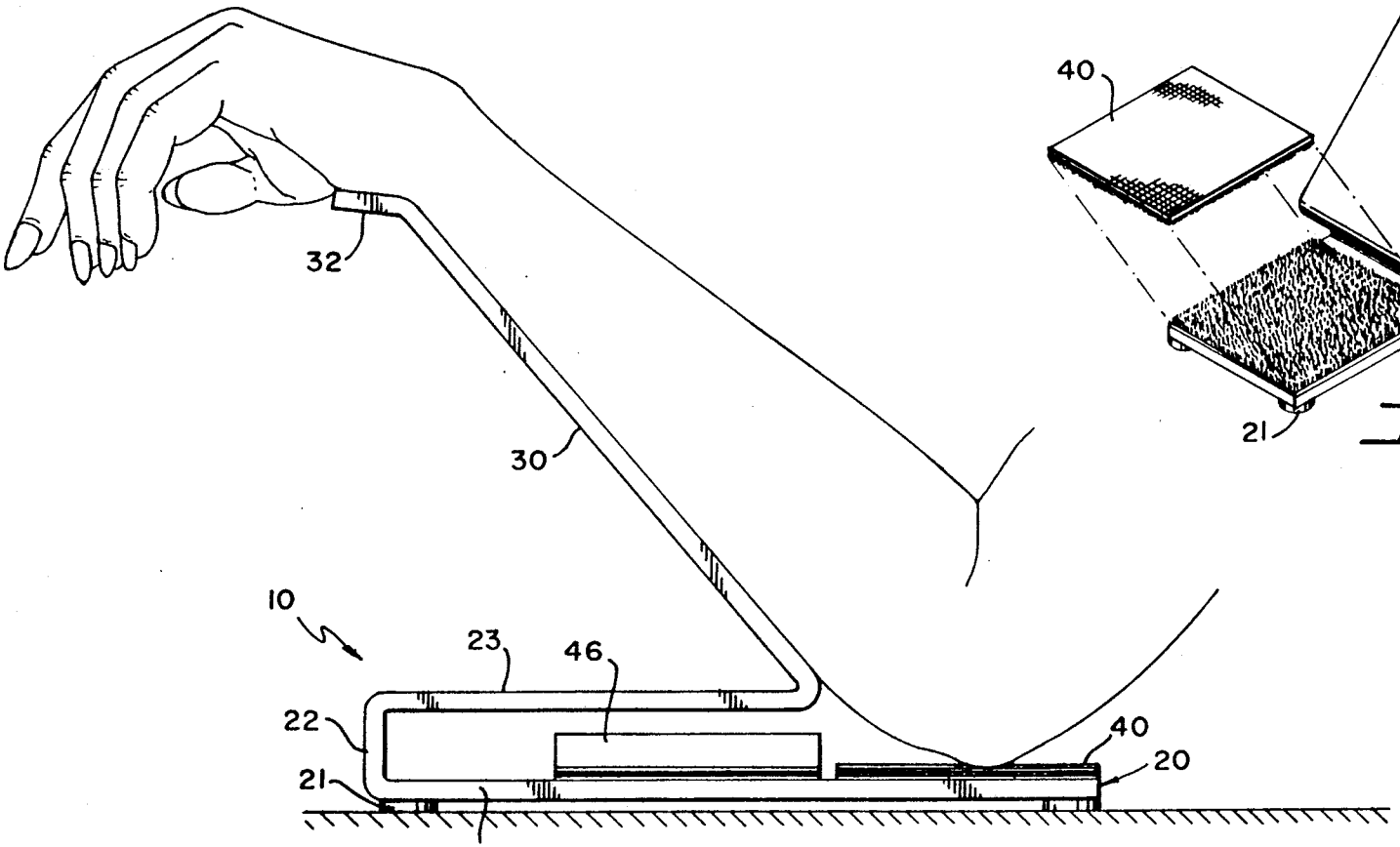
FIG. 1 represents a side view of the stand showing a patron's hand and forearm resting thereon.

Referring now to FIGS. 1 and 2, it can be seen that the present invention is basically referred to with numeral 10, and it is designed to rest on a horizontal surface. Stand 10 includes a base assembly 20 that rests on said horizontal surface and is slightly spaced apart and in parallel disposition with the horizontal surface by virtue of anti-skid pads 21. Base assembly 20, in the preferred embodiment has substancially a U-shape and includes spacer member 22 keeps upper member 23 at a spaced apart relationship with respect to lower member 27. The separation is sufficient to permit the housing of padded sheets 46. Diagonal member 30 extends upperly at an angle with respect to base member 20, and it includes a bend at 32 which corresponds with the approximate area for the location of the user's wrist. It has been found that an angle between 30 and 60 degrees is the most comfortable. Preferably, the width of base assembly 20 and member 30 are uniform and of sufficient width to permit the average patron's forearm to rest thereon. Flexible padded sheet 40, as shown in FIG. 1, is placed adjacent to base member 20 and in the approximate area where the patron's elbow comes in contact with the horizontal surface where stand 10 rests. The purpose of this flexible sheet is twofold: first, to adjust the height in which the patron's elbow rests and, secondly, to provide a softer area for the patron's elbow to rest, thereby making it more comfortable. It should be noted that for patrons with relatively short forearms, additional padded sheets 46 can be added to prop-up the forearm. Velcro pads are attached to the underside of padded sheets 46 and 40. Padded sheet 40 is somewhat thinner than padded sheet 46. Cooperating and opposite Velcro surfaces 42 and 44 are attached to the top surface of lower member 27, as shown in FIG. 2.

In the preferred embodiment, transparent materials, such as plexiglass, have been utilized. This is not a requirement, however, the materials to be utilized should be of the type that they are easy to maintain and keep clean.

Figure 4:
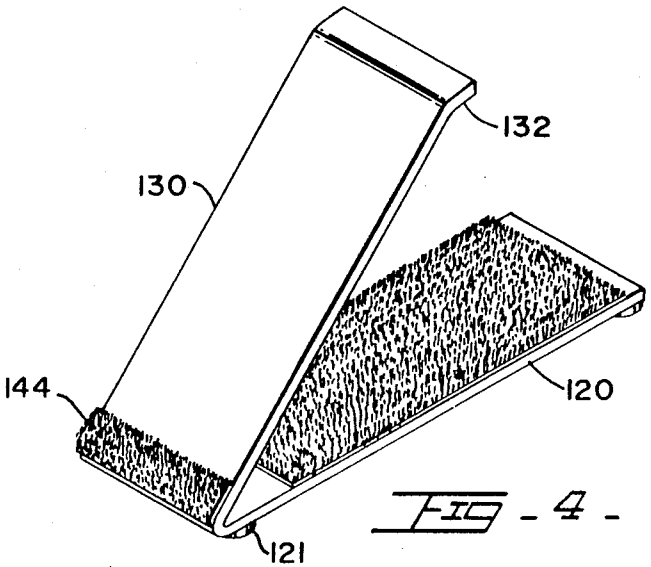
FIG. 4 show an isometric view of the alternate embodiment represented in FIG. 3.
Figure 3:
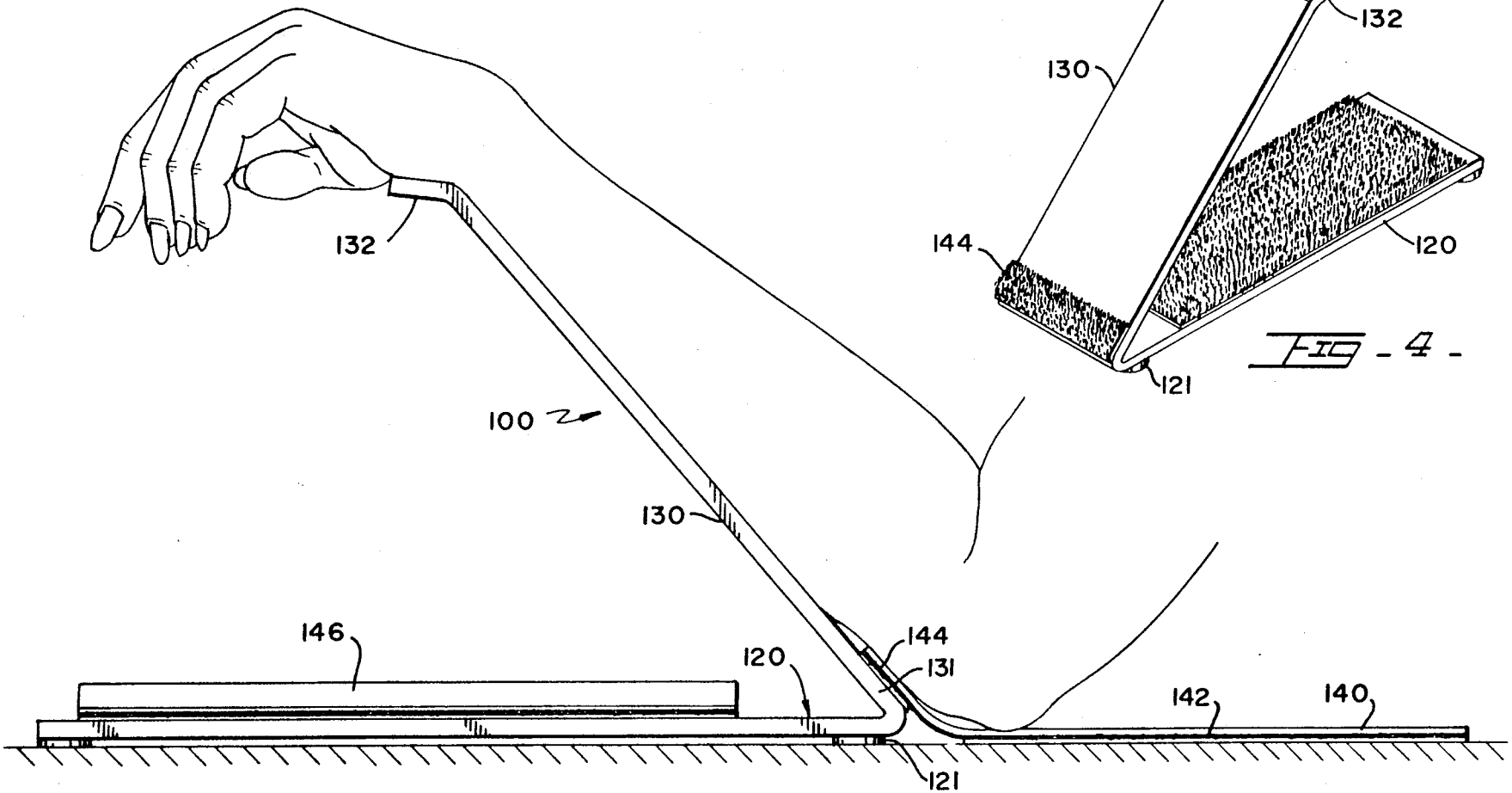
FIG. 3 illustrates a side view of an alternate embodiment for the present invention.

An alternate embodiment 100, shown in FIGS. 3 and 4, includes basically the same members as the preferred embodiment, shown in FIGS. 1 and 2. The main difference being that base member 120 is rigidly mounted at an angle with diagonal member 130. Similarly, anti-skid pads 121 are mounted to the under side of base member 120.

As in the preferred embodiment, it has been found that an angle between 30 and 60 degrees seems to be the most comfortable. Padded sheet 140 is removably mounted to diagonal member 130 and 131 where Velcro pad 144 is attached. Padded sheet 140 has a substantially rectangular shape with one end thereof including a cooperating and opposite Velcro surface 142 that is removably attached to Velcro 144. If a user has short forearms, thicker padded sheet 146 is attached to pad 144 proping up the patron's elbow.

Again, as in the embodiment, the upper end of diagonal member 132 includes a bent portion to conform to a patrons wrist to permit his or her hand to languidly and comfortably drop while being worked on.

It is believed the foregoing description conveys the best understanding of the objects and advantages of the present invention. Different embodiments may be made of the inventive concept of this invention. It is to be understood that all matter disclosed herein is to be interpreted merely as illustrative, and not in a limiting sense.

What is claimed is:

1. A stand to support a patron's hand in suspension and to provide support and comfort for the patron's elbow to be used on a flat horizontal surface, comprising:

A. a flat assembly resting on said flat, horizontal surface and having upper, lower and spacer base members wherein said upper and lower base members are kept at spaced apart parallel relationship with respect to each other by said spacer member; and B. a diagonal flat member rigidly mounted to said base member at one of its ends and extending upwardly at an angle between thirty degrees and sixty degrees with respect to said flat horizontal surface and said diagonal member further including a bend at the other end which substantially coincides with the wrist of said patron.

2. The stand set forth in claim 1 further including:

C. at least one padded sheet member removably mounted to said diagonal member and longitudinally extending therefrom on said lower base member.

3. The stand set forth in claim 2 wherein said padded sheet member includes a surface having hook/loop fastening means covering of one type and said lower base member and said diagonal member including an area having hook/loop fastening means covering of the opposite type so that said padded sheet cooperatively coincides with the patron's elbow.

4. The stand set forth in claim 3 wherein said base member further includes:

D. a plurality of anti-skid pad members mounted on said bottom surface that keeps that base member in a parallel and spaced-apart relationship with respect to said flat horizontal surface.

5. The stand set forth in claim 4 wherein said lower base member includes an area under said upper base member having loop fastening means of the opposite type so that said padded sheet member can be removably stored thereon.

6. The stand set forth in claim 1 further including:

C. at least one padded sheet member removably mounted to said lower base member at a position that cooperatively coincides with the patron's elbow.

7. The stand set forth in claim 6 wherein said padded sheet member includes a surface having hook/loop fastening means covering of one type.

8. The stand set forth in claim 7 wherein said lower base member includes an area under said upper base member having loop fastening means of the opposite type so that said padded sheet member can be removably stored thereon.

* * * * *